US012484682B1

(12) United States Patent
Wiese

(10) Patent No.: US 12,484,682 B1
(45) Date of Patent: Dec. 2, 2025

(54) HAIR COLOR APPLICATOR

(71) Applicant: Thomas H. Wiese, White Settlement, TX (US)

(72) Inventor: Thomas H. Wiese, White Settlement, TX (US)

( * ) Notice: Subject to any disclaimer, the term of this patent is extended or adjusted under 35 U.S.C. 154(b) by 365 days.

(21) Appl. No.: 17/880,316

(22) Filed: Aug. 3, 2022

(51) Int. Cl.

| | |
|---|---|
| ***A45D 34/04*** | (2006.01) |
| ***A45D 19/02*** | (2006.01) |
| ***A45D 19/06*** | (2006.01) |
| ***A46B 5/00*** | (2006.01) |
| ***A46B 7/10*** | (2006.01) |
| ***A46B 9/02*** | (2006.01) |

(Continued)

(52) U.S. Cl.

CPC ..... *A45D 34/042* (2013.01); *A45D 19/026* (2021.01); *A45D 19/06* (2013.01); *A46B 5/00* (2013.01); *A46B 7/10* (2013.01); *A46B 9/023* (2013.01); *A46B 9/026* (2013.01); *A46B 11/0072* (2013.01); *A46B 15/0016* (2013.01); *A46B 2200/104* (2013.01)

(58) Field of Classification Search

CPC ..... A45D 19/0075; A45D 19/012; A45D 19/022; A45D 19/026; A45D 19/06; A45D 2200/25; A45D 19/02; B65D 1/36; A46B 7/10; A46B 17/04; A46B 13/001; A46B 13/08; A46B 9/023; A46B 9/026; A46B 17/00; A46B 17/08; A45B 7/06

USPC ..... 132/208, 209, 200, 286–318; 206/229, 206/581, 557–567; 15/248.1, 248.2

See application file for complete search history.

(56) References Cited

U.S. PATENT DOCUMENTS 993,006 A * 5/1911 Weinstein ..... A46B 11/0024 206/229
1,302,247 A * 4/1919 Troy ..... A45D 24/06 15/169

(Continued)

FOREIGN PATENT DOCUMENTS

CN 106725225 A * 5/2017
CN 214483666 U * 10/2021

(Continued)

OTHER PUBLICATIONS

Electric Hair Dye Brush. Product Listing [online]. Life Changing Products [retrieved on Jun. 26, 2019]. Retrieved from the Internet: <URL: https://lcpshop.net/product/electric-hair-dye-brush/?gclid=CjwKCAjwr8zoBRADEiwANmvpYB_14aETt-3StwfZ24-wc3Jf5sh5BszlmFvsnIL60lp0spUb41uWJRoCT5cQAvD_BwE>.

(Continued)

*Primary Examiner* — Thomas C Barrett
*Assistant Examiner* — Lina Faraj
(74) *Attorney, Agent, or Firm* — Cramer Patent & Design, PLLC.; Aaron R. Cramer

(57) ABSTRACT

The present invention is directed to a hair color applicator. The hair color applicator may comprise an applicator brush and a base. The applicator brush may be operable to apply one or more hair colorings to hair. A trough in the base may hold the one or more hair colorings. One or more removable dividers may be coupled to the trough to separate the one or more hair colorings. The one or more hair colorings may be applied to a brush head of the applicator brush by placing the applicator brush on the base and rotating a plurality of bristles of the brush head through the trough. The one or more hair colorings may be applied to the hair by brushing the hair with the applicator brush.

1 Claim, 4 Drawing Sheets

(51) Int. Cl.
*A46B 11/00* (2006.01)
*A46B 15/00* (2006.01)

(56) References Cited

U.S. PATENT DOCUMENTS 1,590,267 A * 6/1926 Trester ..... A46B 17/04 15/185
2,577,991 A * 12/1951 Morris ..... A45D 24/08 132/123
2,707,300 A * 5/1955 Angelillo ..... A46B 17/00 15/167.1
3,386,453 A * 6/1968 Roberts ..... A45D 24/007 15/23
4,023,230 A * 5/1977 Friedman ..... A46B 7/023 132/121
4,277,193 A * 7/1981 Knaus ..... A46B 7/02 132/148
4,566,473 A * 1/1986 Hyman ..... A46B 5/02 132/120
5,427,120 A * 6/1995 Wong ..... A46B 9/023 132/212
5,845,653 A 12/1998 Abercrombie
6,098,635 A * 8/2000 Marino ..... A46B 9/023 132/226
6,145,513 A 11/2000 Chu et al.
6,302,607 B1 10/2001 Burrowes et al.
6,691,712 B2 2/2004 Chu et al.
7,322,365 B2 * 1/2008 Kelloyan ..... A45D 24/16 132/200
D602,633 S 10/2009 Spagnuolo
7,930,793 B2 * 4/2011 Stydahar ..... A46B 7/06 15/207.2
8,132,541 B1 * 3/2012 Baer, Jr. ..... A46B 9/023 119/664
8,770,207 B2 * 7/2014 Takagi ..... A45D 19/026 132/270
11,083,270 B2 * 8/2021 Elliott ..... A45D 19/012

FOREIGN PATENT DOCUMENTS

KR 20180089189 A * 8/2018
KR 20220120239 A * 8/2022

OTHER PUBLICATIONS

Quadow Hair Dye Color Brush and Bowl Set, Hair Color Brush Mixing Bowl Kit Perfect Tools for Hair Tint Dying Coloring Applicator, 7 Piece Set. (7 Piece set). Product Listing [online]. © 1996-2022, Amazon.com, Inc. [retrieved on Jun. 26, 2019]. Retrieved from the Internet: <URL: https://www.amazon.com/Color-Mixing-Perfect-Coloring-Applicator/dp/B07KY2Z13N>.

Professional Hair Colouring Comb Empty Hair Dye Bottle With Applicator Brush Dispensing Salon Hair Coloring Styling Tool 8080. Product Listing [online]. Copyright Notice © 2004-2022 DHgate.com [retrieved on Jun. 26, 2019]. Retrieved from the Internet: <URL: https://www.dhgate.com/product/professional-hair-colouring-comb-empty-hair/529078137.html?d1_page_num=1&dspm=pcen.sp.list.2.uZpXPWq2EFMIXoWDWLX6&resource_id=529078137&scm_id=search.LIST..@.1T|3|0|unrerank|48_0|ER-B|newes|48_0.#s1-1-1;searl|0999777652:2>.

* cited by examiner

HAIR COLOR APPLICATOR

RELATED APPLICATIONS

Non-applicable.

FIELD OF THE INVENTION

The present invention relates generally to a hair color applicator and more specifically to a hair color applicator that is capable of applying more than one color.

BACKGROUND OF THE INVENTION

Whether to cover gray hair or update a hair color style, people all over the world routinely apply color to their hair. This task is often performed in a beauty salon but sometimes may be performed at home using a home applicator kit.

While many salon or home applicator kits make use of a single color-today's modern styles may often require the application of a variety of colors with the goal of obtaining a deeper color or highlighted color look. However, the even application of a variety of colors simultaneously is not easily accomplished when a user must use two or more applicator tools. Therefore, a need exists for a single hair color applicator that can evenly and simultaneously apply a variety of colors. The development of the hair color applicator fulfills this need in a manner that is cost effective and efficient.

SUMMARY OF THE INVENTION

The principles of the present invention provide for a hair color applicator that has an applicator brush having a brush head and a handle, and a base having a trough disposed on the base to contain the hair colorings. The applicator brush applying a plurality of hair colorings to a plurality of hair.

The brush head may include the bristles coupled to a center shaft. The center shaft may include a distal shaft and a proximal shaft. The distal shaft may be located at a first end of the center shaft. The proximal shaft may be located at the proximal end of the center shaft. The proximal shaft may pass through the handle. The distal shaft may be part of the center shaft that is coupled to the plurality of bristles. The bristles may project from the center shaft radially and define a substantially cylindrical envelope encompassing a plurality of tips from the bristles. The distal end of the distal shaft may be pivotably coupled to a support arm. The proximal shaft may be pivotably coupled to the handle such that the proximal shaft rotates independently of the handle. The proximal shaft may extend beyond the handle and may be coupled to a knob that is adjacent to the proximal end of the handle.

The center shaft and the brush head may be adapted to rotate when a user holds the handle with a firsthand and may turn the knob with a second hand. The handle may surround the proximal shaft. The distal end of the handle may be coupled to the proximal end of a shield. The shield may be a protective cover adjacent to the brush head and may be integrally formed with, or attached to, the support arm. The shield may prevent the hair colorings from being thrown from the brush head onto nearby objects as the brush head rotates. A center axis of the shield may coincide with the center axis of the center shaft. An inside wall of the shield may be farther away from the center shaft than the tips of the bristles such that the bristles do not touch the shield. The handle may include a locking trigger to prevent rotation of the center shaft when the locking trigger is pressed. A plurality of removable dividers may be coupled to the trough to separate the hair colorings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
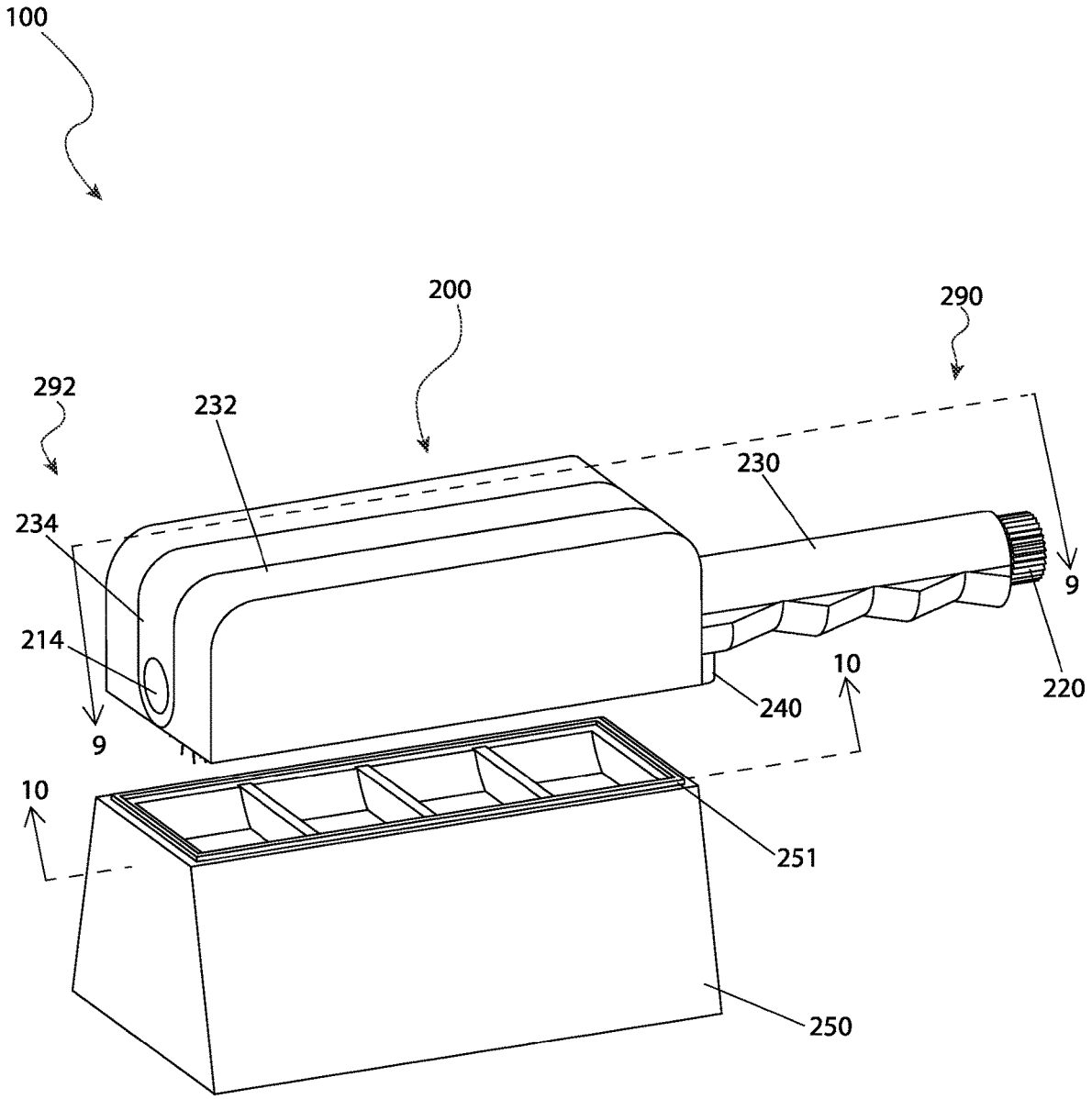
FIG. 1 is a front view of a hair color applicator, according to an embodiment of the present invention.
Figure 2:
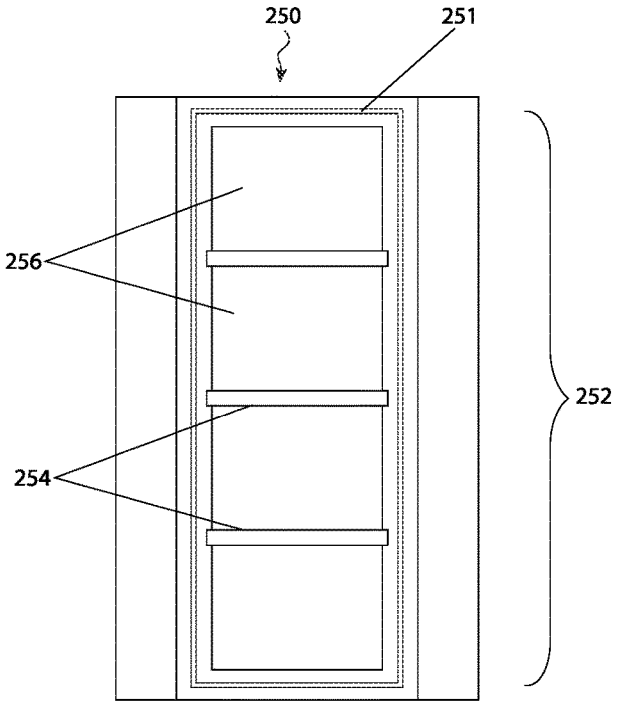
FIG. 2 is a top view of a base, according to an embodiment of the present invention.
Figure 3:
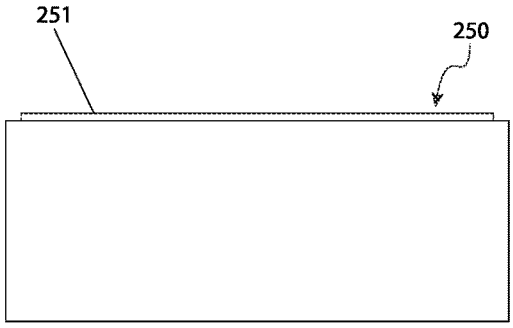
FIG. 3 is a bottom view of the base, according to an embodiment of the present invention.
Figure 4:
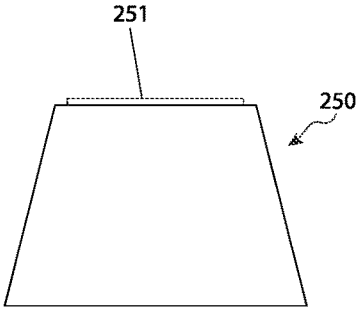
FIG. 4 is a front view of the base, according to an embodiment of the present invention.
Figure 5:
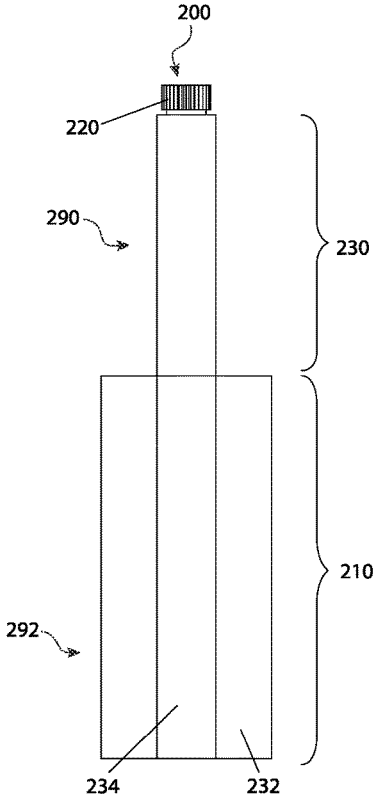
FIG. 5 is a top view of an applicator brush, according to an embodiment of the present invention.
Figure 6:
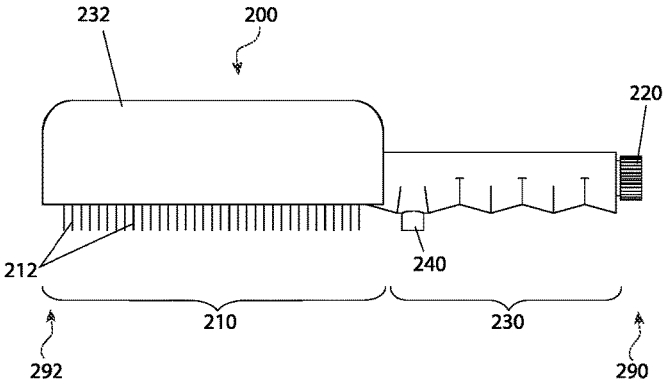
FIG. 6 is a side view of the applicator brush, according to an embodiment of the present invention.
Figure 7:
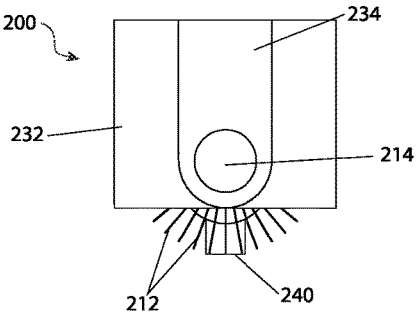
FIG. 7 is a front view of the applicator brush, according to an embodiment of the present invention.
Figure 8:
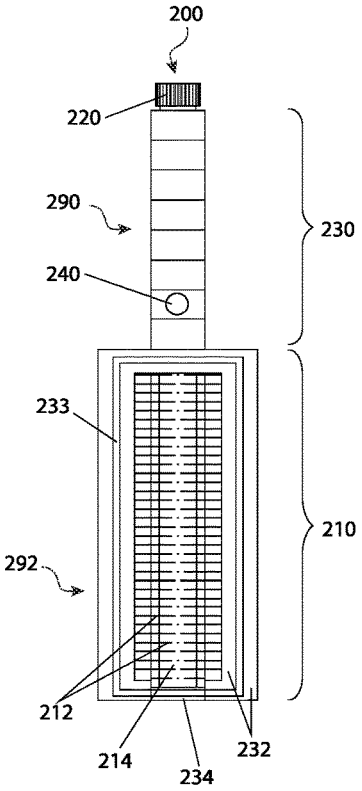
FIG. 8 is a bottom view of the applicator brush, according to an embodiment of the present invention.
Figure 9:
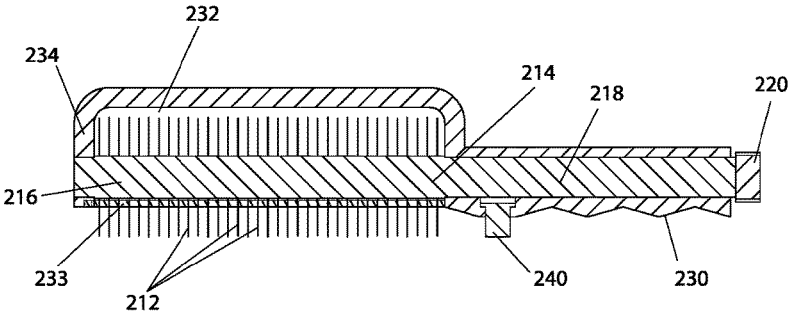
FIG. 9 is a cross-sectional view of the applicator brush across Line 9-9 as shown in FIG. 1, according to an embodiment of the present invention.
Figure 10:
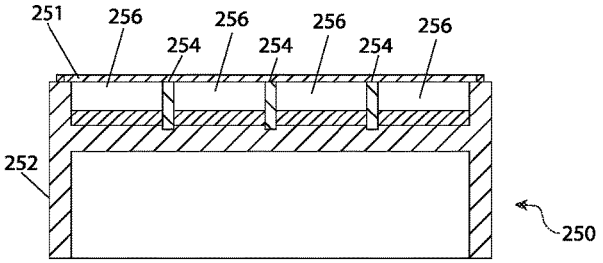
FIG. 10 is a cross-sectional view of the base across Line 10-10 as shown in FIG. 1, according to an embodiment of the present invention.

100 hair color applicator
200 applicator brush
210 brush head
212 bristles
214 center shaft
216 distal shaft
218 proximal shaft
220 knob
230 handle
232 shield
233 groove
234 support arm
240 locking trigger
250 base
251 ridge
252 trough
254 removable divider
256 trough section
290 proximal end
292 distal end

DESCRIPTION OF THE INVENTION

The present invention is directed to a hair color applicator (herein described as the "invention") 100. The invention 100 (hereinafter invention) may comprise an applicator brush 200 and a base 250. The applicator brush 200 may be operable to apply one (1) or more hair colorings to hair. A trough 252 in the base 250 may hold the one (1) or more hair colorings. One (1) or more removable dividers 254 may be coupled to the trough 252 to separate the one (1) or more hair colorings. The one (1) or more hair colorings may be applied to a brush head 210 of the applicator brush 200 by placing the applicator brush 200 on the base 250 and rotating a plurality of bristles 212 of the brush head 210 through the trough 252. The one (1) or more hair colorings may be applied to the hair by brushing the hair with the applicator brush 200.

The applicator brush 200 may comprise the brush head 210 and a handle 230. The applicator brush 200 may be adapted to transfer the one (1) or more hair colorings from the trough 252 to the hair. The brush head 210 may receive the one (1) or more hair colorings from the trough 252 and may release the one (1) or more hair colorings onto the hair. The handle 230 may be adapted to be grasped by a user.

The brush head 210 may comprise the plurality of bristles 212 coupled to a center shaft 214. The plurality of bristles 212 may project from the center shaft 214 radially and may define a substantially cylindrical envelope encompassing the tips of the plurality of bristles 212.

The center shaft 214 may comprise a distal shaft 216 and a proximal shaft 218. The distal shaft 216 may be located at the distal end 292 of the center shaft 214. The proximal shaft 218 may be located at the proximal end 290 of the center shaft 214. The distal shaft 216 may be the portion of the center shaft 214 that is coupled to the plurality of bristles 212. The proximal shaft 218 may pass through the handle 230. The distal end 292 of the distal shaft 216 may be pivotably coupled to a support arm 234. The proximal shaft 218 may be pivotably coupled to the handle 230 such that the proximal shaft 218 may rotate independently of the handle 230. The proximal shaft 218 may extend beyond the handle 230 and may be coupled to a knob 220 that is adjacent to the proximal end 290 of the handle 230. The center shaft 214, and therefore the brush head 210, may be adapted to rotate when the user holds the handle 230 with one (1) hand and turns the knob 220 with the other hand.

The handle 230 may be adapted for the user to grasp while brushing the hair. The handle 230 may surround the proximal shaft 218. The distal end 292 of the handle 230 may be coupled to the proximal end 290 of a shield 232. The shield 232 may be a protective cover adjacent to the brush head 210 and either be integrally formed with, or attached to, the support arm 234. The shield 232 may prevent the one (1) or more hair colorings from being thrown from the brush head 210 onto nearby objects as the brush head 210 rotates. The center axis of the shield 232 may coincide with the center axis of the center shaft 214. The inside wall of the shield 232 may be farther away from the center shaft 214 than the tips of the plurality of bristles 212 such that the plurality of bristles 212 do not touch the shield 232. The shield 232 may cover approximately fifty percent (50%) of the brush head 210. The bottom of perimeter edge of the shield 232 may have a groove 233 located thereon. The groove 233 is preferably a continuous bore.

The shield 232 may be coextensive with the length of the support arm 234 projecting from the distal end 292 of the shield 232 to the center shaft 214. The support arm 234 may pivotably couple to the center shaft 214 and coincidentally motion the shield therewith. The support arm 234 may support the distal end 292 of the center shaft 214 as the center shaft 214 rotates within the handle 230.

The handle 230 may comprise a locking trigger 240. The locking trigger 240 may be operable to prevent rotation of the center shaft 214 when the locking trigger 240 is pressed. As a non-limiting example, the locking trigger 240 may apply frictional pressure against the center shaft 214 to prevent rotation of the center shaft 214. When the locking trigger 240 is pressed to prevent rotation, the applicator brush 200 may be used as a hairbrush to distribute the one (1) or more hair colorings.

The base 250 may be configured to hold a supply of the one (1) or more hair colorings. The bottom of the base 250 may rest on a work area. As non-limiting examples, the work may be a bathroom countertop, top surface of a vanity top, or a tabletop. The top of the base 250 may comprise the trough 252, preferably in the center thereof. Bracketing the trough 252 is a upwardly raised ridge 251 that is continuous and has a geometry enabling the ridge 251 to be frictionally received within the groove 233 of the shield 232.

The trough 252 may be a depression in the top of the base 250 that is operable to hold the hair colorings. The one (1) or more removable dividers 254 may be coupled to or removed from the trough 252 to configure the trough 252 into one (1) or more trough sections 256. With all of the one (1) or more removable dividers 254 removed, the trough 252 comprises one (1) trough section 256 and may hold one (1) coloring. With one (1) divider installed, the trough 252 comprises two (2) trough sections 256 and may hold two (2) colorings. The two (2) trough sections 256 may be of equal or unequal sizes. In a preferred embodiment, there may be three (3) dividers that may create up to four (4) trough sections 256. The trough sections 256 may be left empty, may contain any hair coloring, may contain any highlight, or any combination thereof.

The hair colorings may be transferred to the brush head 210 by: placing the applicator brush 200 on top of the base 250 such that the ridge 251 is seated within the groove 233 and the plurality of bristles 212 reach into the trough 252; and, rotating the knob 220 to pass the plurality of bristles 212 through the hair colorings in the trough 252. The plurality of bristles 212 that pass through a first trough section 256 may pick up a first hair coloring, the plurality of bristles 212 that pass through a second trough section 256 may pick up a second hair coloring, the plurality of bristles 212 that pass through a third trough section 256 may pick up a third hair coloring, and the plurality of bristles 212 that pass through a fourth trough section 256 may pick up a fourth hair coloring. If any of the trough sections 256 are left empty, then the corresponding bristles 212 will not pick up a hair coloring.

The hair colorings may be adapted to be applied to the hair by grasping the handle 230 and brushing the hair with the brush head 210. As the brush head 210 is pulled through the hair, the brush head 210 may be free to rotate and thereby present more of the plurality of bristles 212 and the hair colorings to the hair.

The locking trigger 240 may be adapted to prevent rotation of the brush head 210 if the user presses the locking trigger 240. Preventing rotation by pressing the locking trigger 240 and then brushing the hair may permit the user to distribute the hair colorings through the hair in a pattern of the user's choice.

In use, the removable dividers 254 may be coupled to or removed from the trough 252 as desired to configure the trough sections 256. Each of the trough sections 256 may be left empty, filled with any hair coloring product, or filled with any highlight product. The plurality of bristles 212 may pick up the contents of the trough sections 256 when the applicator brush 200 is placed on top of the base 250 and the knob 220 is rotated to pass the plurality of bristles 212 through the trough sections 256. Hair coloring products and highlight products may be applied simultaneously to different areas of the hair by placing the products in different sections of the trough 252 such that the plurality of bristles

212 passing through different sections of the trough 252 may pick up different products, different colors, or nothing at all. As a non-limiting example, the plurality of bristles 212 passing through the first trough section 256 may pick up a first hair coloring, the plurality of bristles 212 passing through the second trough section 256 may pick up a second hair coloring, the plurality of bristles 212 passing through the third trough section 256 may pick up no product at all, and the plurality of bristles 212 passing through the fourth trough section 256 may pick up a highlight. The user may then brush the hair with the applicator brush 200 such that the brush head 210 passes through the hair and rotates as the brush head 210 moves. The plurality of bristles 212 may transfer the products to the hair as the hair is brushed. The user may press the locking trigger 240 to stop rotation of the brush head 210 while brushing in order to distribute the products as they desire.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A hair color applicator system, consisting of:

an applicator brush consisting of a brush head and a handle, the brush head consisting of a plurality of bristles projecting radially from a center shaft, the center shaft consisting of a distal shaft and a proximal shaft; and the handle consisting of a locking trigger configured to prevent rotation of the center shaft when the locking trigger is pressed;

a knob coupled to the proximal shaft, the proximal shaft extending through the handle and beyond a proximal end of the handle, wherein the knob is positioned adjacent to the proximal end of the handle and is operable to rotate the center shaft and the plurality of bristles;

a shield consisting of a cylindrical wall covering approximately fifty percent of the brush head, the shield positioned adjacent to the brush head and attached to a support arm, the support arm pivotably coupled to the distal shaft of the center shaft, the proximal shaft being pivotably coupled to the handle such that the center shaft rotates independently of the handle, and the shield including an inner wall spaced apart from the bristles to avoid contact during rotation, the shield further including a groove located along a perimeter edge;

a base consisting of a bottom support and an upwardly raised ridge surrounding a trough, the ridge frictionally received within the groove of the shield, the trough operable to hold one or more hair colorings; and, a plurality of removable dividers coupled to the trough to configure the trough into a plurality of trough sections, wherein placement of the applicator brush on the base causes the bristles to contact the trough sections such that rotation of the knob transfers hair colorings from the trough to the bristles.

* * * * *